United States Patent [19]

Morishita et al.

[11] 4,172,528

[45] Oct. 30, 1979

[54] APPARATUS FOR SELECTING TABLETS

[75] Inventors: Kazuo Morishita; Takeshi Kyoda, both of Fuji, Japan

[73] Assignee: Fujisawa Pharmaceutical Co., Ltd., Osaka, Japan

[21] Appl. No.: 895,223

[22] Filed: Apr. 10, 1976

[51] Int. Cl.[2] ..... B07C 5/12

[52] U.S. Cl. ..... 209/680; 209/644

[58] Field of Search ..... 209/680, 920, 644

[56] References Cited

U.S. PATENT DOCUMENTS

| | | | |
|---|---|---|---|
| 1,701,641 | 2/1929 | Skriba | 209/680 |
| 3,942,645 | 3/1976 | Aronson | 209/680 |
| 3,997,058 | 12/1976 | Greer et al. | 209/680 |
| 4,024,058 | 5/1977 | Derckx | 209/680 |

*Primary Examiner*—Allen N. Knowles

*Attorney, Agent, or Firm*—Oblon, Fisher, Spivak, McClelland & Maier

[57] ABSTRACT

A tablet selecting apparatus comprising a horizontally rotatable circular perforated plate having a multiplicity of perforations for passing reject tablets therethrough, a vibrator for giving vibrations to the perforated plate, a tablet feeding chute having a feeding outlet disposed above and opposed to the perforated plate at a position other than the center of the plate, an acceptable tablet blocking member provided adjacent the feeding outlet on one side thereof opposite to the direction of rotation of the perforated plate and spaced from the perforated plate by a clearance not permitting passage of the tablets therethrough, a compressed air injecting duct provided adjacent the blocking member on one side thereof opposite to the direction of rotation of the perforated plate and having an air outlet directed toward the outer periphery of the perforated plate, and a reject tablet receptacle disposed below the perforated plate. The tablets to be separated for selection are fed from the feeding outlet onto the perforated plate and make approximately one revolution with the rotation of the perforated plate. During the revolution, reject tablets having a smaller diameter than the perforations pass through the perforated plate into the tablet receptacle. The acceptable tablets impeded by the blocking member as retained on the plate are removed from the plate by the air forced out from the injecting duct.

9 Claims, 4 Drawing Figures

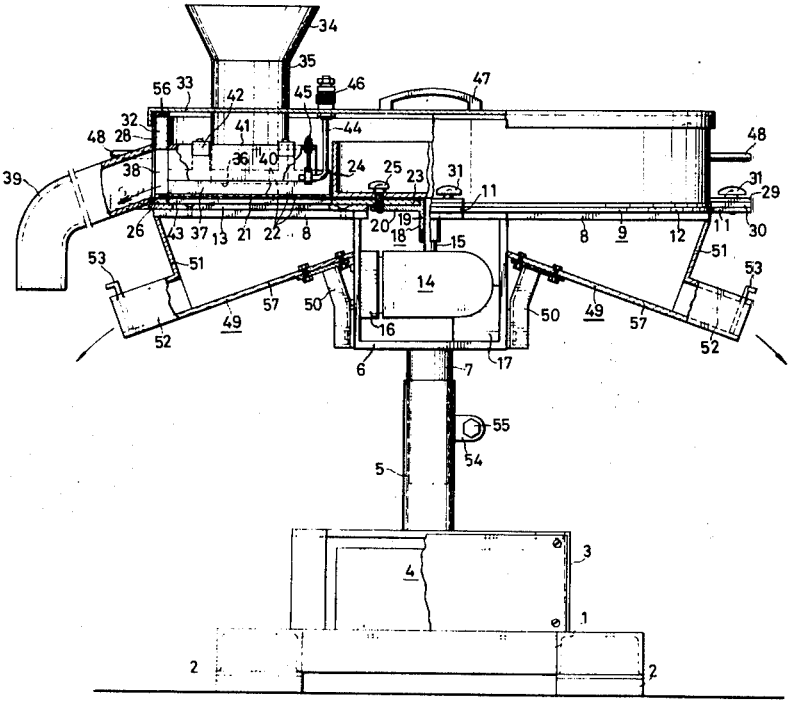

APPARATUS FOR SELECTING TABLETS

BACKGROUND OF THE INVENTION

This invention relates to a tablet selector, and more particularly to an apparatus for selecting tablets according to the diameter of the tablets.

Throughout the specification and the appended claims, the term "reject tablet" means a tablet having a diameter smaller than the specified diameter, and the term "acceptable tablet" means a tablet other than the reject tablet.

Generally the tablets to be separated for selection include up to about 50 to 60 reject tablets per 300,000 tablets. Apparatus for separating off such reject tablets heretofore known comprise a square perforated plate disposed in a substantially inclined position and a vibrator for vibrating the perforated plate. With the known apparatus, the tablets fed to the upper end of the perforated plate for separation are moved progressively downward to its lower end, while allowing reject tablets to fall through perforations formed in the plate. The apparatus, however, have the drawback of involving extreme difficulty in adjusting the vibration to be given to the perforated plate. If the vibration of the perforated plate is too small, acceptable tablets will clog some perforations with their lower half portions and be held engaged therein, thus hindering separation of other tablets, whereas the perforated plate, if vibrated to excess, will permit the tablets to rapidly descend the sloping surface of the perforated plate and reach its lower end without allowing the reject tablets to fall through the perforations.

SUMMARY OF THE INVENTION

The present invention provides an apparatus for selecting tablets free of the foregoing drawback and comprising a horizontally rotatable circular perforated plate having a multiplicity of perforations for passing reject tablets therethrough, a vibrator for giving vibrations to the perforated plate, at least one tablet feeding chute having a feeding outlet disposed above and opposed to the perforated plate at a position other than the center of the plate, an acceptable tablet blocking member provided adjacent the feeding outlet on one side thereof opposite to the direction of rotation of the perforated plate and spaced from the perforated plate by a clearance not permitting passage of the tablets therethrough, an acceptable tablet discharging means for removing from the perforated plate the acceptable tablets impeded by the blocking member, and a reject tablet receptacle disposed below the perforated plate for accommodating the reject tablets passing through the perforated plate. Since the perforated plate is horizontal , vibrations of somewhat greater amplitude, if given thereto, will cause no trouble to the separation of tablets. Accoringly an improved tablet selecting efficiency is achievable by suitably determing the speed of rotation of the perforated plate and the vibration amplitude.

DESCRIPTION OF THE PREFERRED EMBODIMENTS

Figure 1:
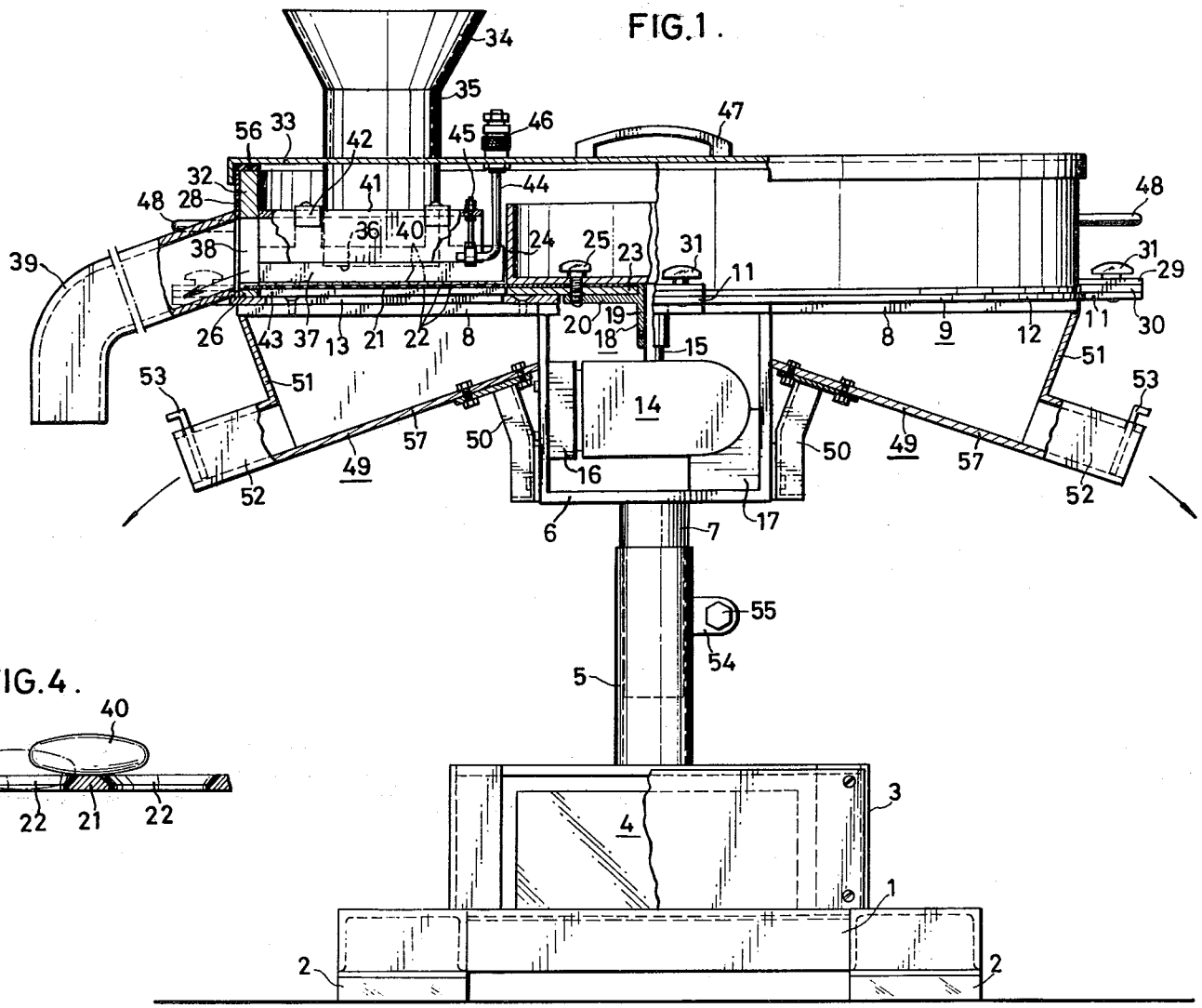
FIG. 1 is a side elevation partly broken away and showing an apparatus of this invention for selecting tablets.
Figure 4:
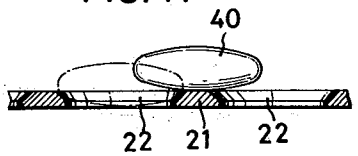
FIG. 4 is a fragmentary sectional view on an enlarged scale showing a perforated plate.
Figure 2:
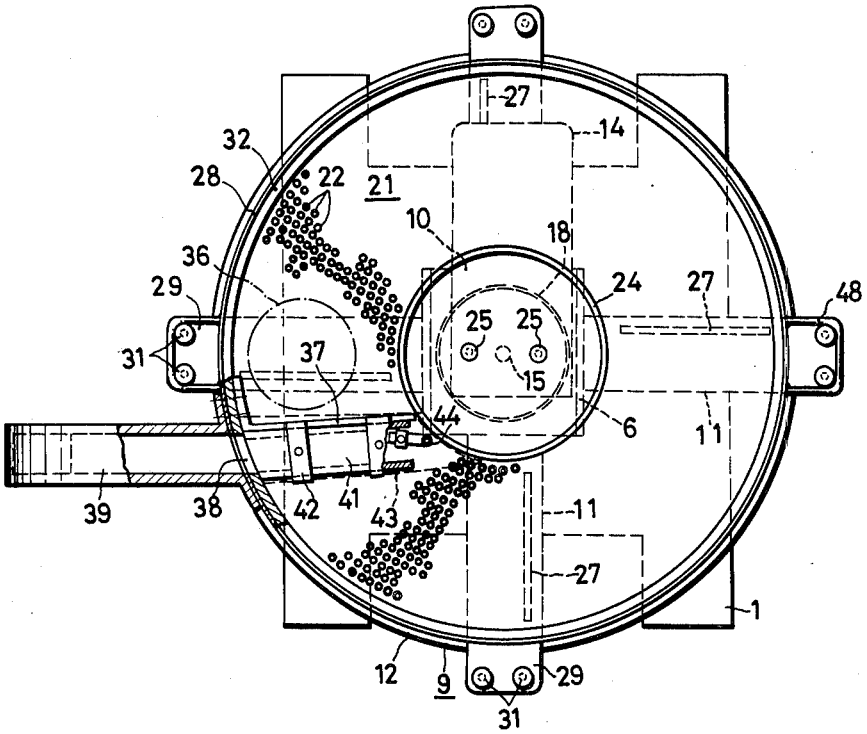
FIG. 2 is a plan view partly broken away and showing the apparatus with its cover removed.
Figure 3:
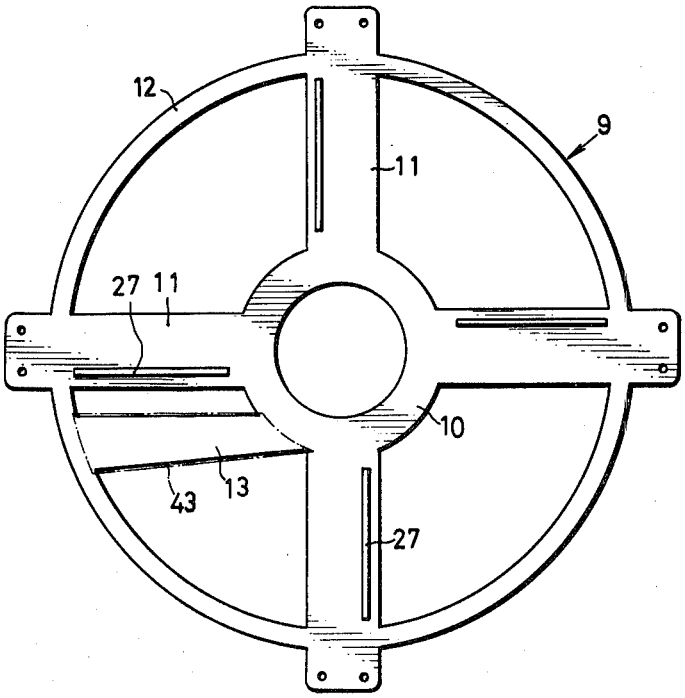
FIG. 3 is a plan view showing a bottom flame.

With reference to FIGS. 1 to 3, a base frame 1 is H-shaped in plan and is provided with thick rubber plates 2 adhered to the bottom of its opposite side portions. A box-shaped housing 3 for accommodating a vibrator 4 is provided on the base frame 1. A lower tubular post 5 extends upright from the center of the top wall of the vibrator housing 3. An unillustrated vertical cutout formed in the lower post 5 extends from its upper end. The post 5 has a pair of opposed vertical ears 54 on the opposite sides of the cutout and provided with a set of bolt and nut 55. An upper tubular post 7 has an outside diameter approximately equal to the inside diameter of the lower post 5. The lower post 5 is fastened to the upper post 7 by the bolt and nut 55 with part of the upper post 7 inserted into the lower post 5 to an adjusted length. A U-shaped holder 6 mounted on the upper end of the post 7 holds a motor 14 with liners 16 and 17 provided therebetween. Four arms 8 extend radially outward from the upper end of the motor holder 6 and support thereon a bottom frame 9. As seen in FIG. 3, the bottom frame 9 comprises an inner ring 10 of large width, an outer ring 12 of small width, four strips 11 equidistantly spaced apart circumferentially of the inner ring 10 and extending radially outward from the inner ring 10 slightly beyond the outer ring 12, and another strip 13 extending from the ring 10 to the ring 12 in parallel to one of the strips 11. Between the rings 10 and 12, each of the strips 11 is provided with a round bar 27 positioned close to one side of the strip and secured thereto. The strips 11 are superposed on and screwed to the arms 8. The outer ends of the arms 8 coincide with the outer periphery of the outer ring 12. Thus the portions of the strips 11 extending from the outer ring 12 project outward from the arms 8. A support ring 26 superposed on the outer ring 12 is secured to the outer ring 12. The output shaft 15 of the motor 14 extends vertically upward.

A member 18 for mounting a circular, horizontally rotatable, perforated plate 21 includes a tubular portion 19 fixedly mounted on the output shaft 15 and a flange 20 formed on the tubular portion 19 and positioned close to the upper end of the portion 19. The flange 20 supports thereon a circular support plate 23, on which the perforated plate 21 is positioned with a bottomed hollow cylinder 24 placed on the plate 21. The support plate 23 and the perforated plate 21 are each centrally formed with a circular hole conforming to the outer periphery of the tubular portion 19 of the mounting member 18. The plates 23 and 21 fit around the tubular portion 19. The upper surface of the perforated plate 21 is flush with the upper end face of the tubular portion 19. The outer peripheries of the support plate 23 and of the bottomed cylinder 24 are in coincidence with the outer periphery of the inner ring 10 of the bottom frame 9. The outer peripheral portion of the perforated plate 21 is supported by the ring 26. The perforated plate 21 is formed with a multiplicity of perforations 22 upwardly flaring at the middle of the thickness of the plate for passing reject tablets therethrough. The perforated plate 21 is made of polycarbonate and has a thickness of 1.5 mm. The perforation 22 has a diameter of 10.0 mm at its lower end and a diameter of 12.0 mm at its upper end. The center-to-center distance between the adjacent perforations 22 is 14.0 mm. The shortest distance between the upper ends of adjacent perforations 22 is 2.0 mm. Tablets 40, when acceptable, are 10.3 mm in diameter. The bottom wall of the inner cylinder 24, perforated plate 21 and support plate 23 are fastened to the flange 20 by thumbscrews 25.

A circular surrounding wall 28 provided with a pair of handles 48 is fitted at its lower end to the outer peripheral upper portion of the support ring 26. An outer hollow cylinder 32 opposed to the inner cylinder 24 is secured to the surrounding wall 28. The outer cylinder 32 has a thickness equal to the width of the support ring 26. The cylinder 32 has an upper end flush with the upper end of the surrounding wall 28 and a lower end positioned slightly above the lower end of the surrounding wall 28 to provide between the support ring 26 and the outer cylinder 32 a clearance for freely rotatably receiving the outer peripheral portion of the perforated plate 21. The clearance, however, is not so large as to permit the ingress of the tablets 40. The surrounding wall 28 is provided at its lower end with four horizontal ears 29 radially extending outward and fastend to the projections of the strips 11 of the bottom frame 9 by thumbscrews 31, with a spacer 30 provided between each opposed pair of ear 29 and projection.

A packing 56 is provided over the upper ends of the wall 28 and the outer cylinder 32. A cap 33 having a center handle 47 is fitted over the wall 28 with the packing 56 interposed therebetween. The cap 33 is made of transparent acrylic resin to enable the operator to observe the upper surface of the perforated plate 21. A tablet feeding chute 35 has an upper end provided with a hopper 34 and a lower end extending through the cap 33. Between the inner and outer cylinders 24 and 32, the feeding outlet 36 of the chute 35 is positioned above a strip 11 and opposed to the perforated plate 21 from above. The chute 35, although shown as having a short length, extends a long distance from an apparatus for selecting tablets according to the thickness and terminates in the lower end under the cap 33.

A platelike member 37 for blocking acceptable tablets is positioned adjacent the feeding outlet 36 on one side thereof opposite to the direction of rotation of the perforated plate 21. The blocking member 37 is disposed vertically as spaced from the perforated plate 21 by a clearance not permitting the passage of the tablets 40 therebetween. The blocking member 37 has one end bent to extend along the inner surface of the outer cylinder 32 and screwed thereto and the other end extending close to the inner cylinder 24. As seen in FIG. 2, the blocking member 37 is positioned at a specified angle with a radial line of the perforated plate 21 and extends obliquely with respect to the direction of rotation of the perforated plate.

An L-shaped duct 44 for injecting compressed air is provided adjacent to the blocking member 37 and to the inner cylinder 24 on one side of the member 37 opposite to the direction of rotation of the perforated plate 21. The air injecting duct 44 has an upper end extending through the cap 33 and secured to the cap by a mounting 46. The duct 44 is in communication with a compressed air source through a pipe (not shown). A hood 41 of inverted U-shaped cross section is fitted from below to two arms 42 extending upward from the upper edge of the blocking member 37 and bent to an inverted U-shape in conformity with the shape of the upper portion of the hood 41. The hood 41 is secured to the arms 42 by screws and is suspended therefrom as spaced apart from the perforated plate 21 by a distance permitting the tablets 40 to pass below the hood free of any interference. The hood 41 has one end in contact with the inner surface of the outer cylinder 32 and the other end extending almost to the vertical portion of the injecting duct 44. The horizontal portion of the injecting duct 44 extending into the hood 41 is supported by a hanger 45 suspended from the top wall of the hood 41. The air outlet of the injecting duct 44 is directed toward the outer periphery of the perforated plate 21. The strip 13 is positioned below the hood 41 and fixedly provided thereon with an elongated plate 43 having the same thickness as the support plate 23 and support ring 26. The round bars 27 on the strips 11 of the bottom plate 9 have a diameter slightly smaller than the thickness of the elongated plate 43. The bars 27, which are usually out of contact with the perforated plate 21, serve to prevent undesired downward deflection of the perforated plate 21. The surrounding wall 28 and the outer cylinder 32 are cut out in their lower ends to provide an opening 38 communicating with the interior of the hood 41. The surrounding wall 28 is provided with an acceptable tablet outlet member 39 inclined outwardly downward and having a vertical lower end portion. The outlet member 39 is in communication with the opening 38.

A reject tablet receptacle is disposed below the perforated plate 21. In the illustrated embodiment, the receptacle comprises a pair of receiving portions 49 attached to the bottom frame 9 and the arms 8 extending from the motor holder 6. The receiving portions 49, each in a substantially semicircular form when seen in plan, are provided on the opposite sides of two diametrically aligned strips 11 of the bottom frame 9 symmetrically therewith. The side wall 51 of each receiving portion 49 extends obliquely outwardly upward to the outer periphery of the ring 12 of the bottom frame 9. The side wall 51 is provided in its lower portion with a reject tablet outlet member 52 extending obliquely outwardly downward. The outlet member 52, rectangular to square in cross section, has a shutter 53 inserted into the interior thereof through a slit formed in the upper end wall of the member 52. The bottom wall 57 of the receiving portion 49 extends into the bottom wall of the outlet member 52 with the same inclination therewith and is formed in its inner end portion with a cutout fitting around the motor holder 6. The inner end portion is secured to a support member 50 fixed to the side wall of the motor holder 6.

According to this invention, the vibrator 4, when operated, vibrates the whole apparatus including the base frame 1 except the tablet feeding chute 35. The chute 35 is fixed to another apparatus for selecting tablets according to the thickness of the tablets and has a lower end which loosely extends through the cap 33, permitting free vibration of the cap 33. The vibration of the overall apparatus is absorbed by the rubber plates 2 on the bottom of the base frame 1 in contact with the floor. The vibration frequency is approximately 3,300/min. The motor 14, which is actuated simultaneously with the vibrator 4, rotates the perforated plate 21 at a speed of about 5 r.p.m. in a clockwise direction in FIG. 2 while the plate 21 is being vibrated. The tablets 40 placed into the hopper 35 for separation are passed through the chute 35 and fed from the feeding outlet 36 onto the perforated plate 21 in the above-mentioned state. The tablets 40 on the perforated plate 21 slowly travel with the plate 21 through an annular path defined by the inner cylinder 24 and the outer cylinder 32. The inner cylinder 24 serves to hold the perforated plate 21 between its bottom wall and the support plate 23, thereby fixing the plate 21 to the flange 20 of the mounting member 18, and also to prevent the tablets 40 from gathering in the center of the plate 21. If tablets come to the center of the perforated plate 21, the tablets would revolve over an invariably shortened distance, and insufficient separation would result. While the tablets 40 travel from the position below the feeding outlet 36 to the acceptable tablet blocking member 37, the reject tablets fall through perforations 22 in the plate 21 into the receiving portions 49. Since the perforation 22 is upwardly flared, tablets come into perforations 22 with greater ease than into straight perforations. With the perforated plate 21 positioned horizontally, all the reject tablets will fall through perforations 22 and are thereby separated off by being subjected to vibrations while the plate 21 makes approximately one turn of rotation. The acceptable tablets, on reaching the blocking member 37 as retained on the plate 21, are prevented from further travel and remain in the position below the hood 41, where a tunnel is defined by the hood 41 and the elongated plate 43 disposed therebelow, with the perforated plate 21 extending over the plate 43. The impeded tablets 40 are blown toward the outer periphery of the plate 21 by the air forced out from the duct 44, as guided by the tunnel to the opening 38, and then led into the outlet member 39. The acceptable tablets discharged from the outlet member 39 are received by an unillustrated container and thereafter carried on a belt conveyor, for example, to a tablet printing machine. When a quantity of reject tablets have accumulated in the receiving portions 49, the shutters 53 are opened to run off the tablets through the outlet member 52.

For the separation of tablets of different size, the thumbscrews 31 are loosened, and the surrounding wall 28 joined to the outer cylinder 32 are removed from the bottom frame 9 along with the blocking member 37, hood 41, air injecting duct 44 and cap 33. Subsequently the thumbscrews 25 are loosed to remove the inner cylinder 24 from the flange 20 of the mounting member 18. The chute 35 is withdrawn from the cap 33 before the removal of the surrounding wall 28 from the bottom frame 9. The perforated plate 21 is replaced by another perforated plate having perforations suitable for the tablets of different size to be separated. The inner cylinder 24, surrounding wall 28 and other parts are therafter reinstalled in place.

Although the embodiment described is so adapted that reject tablets are separated off during approximately one turn of the perforated plate, separation of tablets can be carried out while the perforated plate makes approximately one-half turn or a smaller amount of rotation, with use of an increased number of chutes, blocking members, air injecting ducts and acceptable tablet outlet members in accordance with the size and speed of rotation of the perforated plate. The blocking member and the hood, which are provided as separate pieces in the foregoing embodiment, may be in the form of an integral member. Further although the acceptable tablets impeded by the blocking member are adapted to be removed from the perforated plate by compressed air, the discharging means is not limited thereto.

What is claimed is:

1. An apparatus for selecting tablets comprising a horizontally rotatable circular perforated plate having a multiplicity of perforations for passing reject tablets therethrough, a vibrator for giving vibrations to the perforated plate, at least one tablet feeding chute having a feeding outlet disposed above and opposed to the perforated plate at a position other than the center of the plate, an acceptable tablet blocking member provided adjacent the feeding outlet on one side thereof opposite to the direction of rotation of the perforated plate and spaced from the perforated plate by a clearance not permitting passage of the tablets therethrough, an acceptable tablet discharging means for removing from the perforated plate the acceptable tablets impeded by the blocking member, and a reject tablet receptable disposed below the perforated plate for accommodating the reject tablets passing through the perforated plate.

2. An apparatus as defined in claim 1 wherein each of the perforations is an upwardly flaring perforation.

3. An apparatus as defined in claim 1 wherein the acceptable tablet blocking member is positioned at a specified angle with a radial line of the perforated plate and obliquely with respect to the direction of rotation of the perforated plate.

4. An apparatus as defined in claim 1 wherein the acceptable tablet discharging means is a compressed air injecting duct having an air outlet directed toward the outer periphery of the perforated plate.

5. An apparatus for selecting tablets comprising a base frame provided with an elastic material on its bottom surface, a housing accommodating a vibrator and provided on the top of the base frame, a support post extending upright from the vibrator housing, a holder holding a motor therein and mounted on the upper end of the support post, a horizontally rotatable circular perforated plate connected to an output shaft extending vertically upward from the motor and having a multiplicity of perforations for passing reject tablets therthrough, an outer and an inner hollow cylinder arranged to define an annular path on the perforate plate, at least one tablet feeding chute having a feeding outlet positioned between the outer and inner cylinders and opposed to the perforated plate from thereabove, an acceptable tablet blocking member provided vertically adjacent the feeding outlet on one side thereof opposite to the direction of rotation of the perforated plate and spaced from the perforated plate by a clearance not permitting passage of the tablets therethrough, an L-shaped compressed air injecting duct provided adjacent to the blocking member and to the inner cylinder on one side of the blocking member opposite to the direction of rotation of the perforated plate and having an air outlet directed toward the outer periphery of the perforated plate, a hood spaced apart from the perforated plate by a distance permitting passage of tablets therebetween and having one end in contact with the inner surface of the outer cylinder and the other end extending approximately to the injecting duct with a horizontal portion of the duct extending into the hood, an acceptable tablet outlet member in communication with an opening formed in the outer cylinder and communicating with the interior of the hood, a reject tablet receptable disposed below the perforated plate, and a reject tablet outlet member provided for the receptacle.

6. An apparatus as defined in claim 5 wherein the acceptable tablet outlet member is inclined outwardly downward and has a vertical lower end portion.

7. An apparatus as defined in claim 5 wherein the reject tablet receptacle comprises a pair of symmetrically arranged receiving portions each in a substantially semicircular form and having an outwardly upwardly extending oblique side wall, the reject tablet outlet member extending obliquely outwardly downward, each of the receiving portions having a bottom wall extending into the bottom wall of the reject tablet outlet member with the same inclination therewith.

8. An apparatus as defined in claim 5 wherein the reject tablet outlet member is rectangular to square in cross section and having a shutter inserted into the interior thereof through a slit formed in the upper end wall of the outlet member.

9. An apparatus for selecting tablets comprising a base frame provided with an elastic material on its bottom surface; a housing accommodating a vibrator and provided on the top of the base frame; a support post extending upright from the vibrator housing; a holder holding a motor therein and mounted on the upper end of the support post; four arms extending radially outward from the upper end of the motor holder; a bottom frame including an inner ring, an outer ring and four strips extending radially outward from the inner ring and projecting slightly outward from the outer ring, the strips being superposed on and secured to the arms respectively; a perforated plate mounting member including a tubular portion and a flange extending from the tubular portion and positioned close to the upper end thereof, the tubular portion being fixedly mounted on an output shaft extending vertically upward from the motor; a circular support plate superposed on the flange and having a circular center hole fittingly receiving therein the mounting member tubular portion, the support plate having an outer periphery substantially in coincidence with the outer periphery of the bottom frame inner ring; a support ring superposed on and secured to the bottom frame outer ring and having substantially the same size as the outer ring; a horizontally rotatable circular perforated plate superposed on the support plate and having a center circular hole fittingly receiving therein the mounting member tubular portion, the perforated plate being supported at its outer peripheral portion on the support ring and having a multiplicity of upwardly flaring perforations for passing reject tablets therethrough; an inner hollow cylinder superposed on the perforated plate and having a bottom wall of substantially the same area as the support plate, the cylinder bottom wall being fastened to the mounting member flange by thumbscrews along with the perforated plate and support plate; a surrounding wall fitting to the outer peripheral upper portion of the support ring and having at its lower end four radially outwardly extending horizontal ears fastened to the strip projections of the bottom frame by thumbscrews with a spacer interposed between each opposed pair of the ear and the projection; an outer hollow cylinder secured to the inner surface of the surrounding wall and spaced from the support ring by a clearance freely rotatably receiving therein the outer peripheral portion of the perforated plate but not permitting ingress of tablets thereinto; a cap fitting over the surrounding wall; at least one tablet feeding chute having a lower end extending through the cap and a feeding outlet positioned between the outer and inner cylinders and opposed to the perforated plate from thereabove; a platelike acceptable tablet blocking member provided vertically adjacent the feeding outlet on one side thereof opposite to the direction of rotation of the perforated plate and spaced form the perforated plate by a clearanc not permitting passage of the tablets therethrough, the blocking member having one end bent to extend along the inner surface of the outer cylinder and secured to the outer cylinder and the other end extending approximately to the inner cylinder; an L-shaped compressed air injecting duct provided adjacent to the blocking member and to the inner cylinder on one side of the blocking member opposite to the direction of rotation of the perforated plate and having an air outlet directed toward the outer periphery of the perforated plate, the air injecting duct having an upper end extending through and secured to the cap; a hood of inverted U-shaped cross section spaced apart from the perforated plate by a distance permitting passage of tablets therebetween and having one end in contact with the inner surface of the outer cylinder and the other end extending approximately to the injecting duct with a horizontal portion of the duct extending into the hood; an acceptable tablet outlet member in communication with an opening formed in the surrounding wall and in the outer cylinder and communicating with the interior of the hood; a reject tablet receptacle disposed below the perforated plate; and a reject tablet outlet member provided for the receptable.

* * * * *